US009119988B2

(12) United States Patent
Murray et al.

(10) Patent No.: US 9,119,988 B2
(45) Date of Patent: Sep. 1, 2015

(54) TRAINING MACHINE PROVIDING ADJUSTABLE HANDRAIL SPACE

(71) Applicant: Dyaco International Inc., Taipei (TW)

(72) Inventors: Brian Murray, Taipei (TW); Feng-Ren Huang, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 33 days.

(21) Appl. No.: 14/208,071

(22) Filed: Mar. 13, 2014

(65) Prior Publication Data

US 2015/0196796 A1 Jul. 16, 2015

(30) Foreign Application Priority Data

Jan. 10, 2014 (TW) ..... 103200626 U

(51) Int. Cl.

| | |
|---|---|
| ***A63B 22/00*** | (2006.01) |
| ***A63B 22/04*** | (2006.01) |
| ***A63B 71/00*** | (2006.01) |
| ***A63B 22/02*** | (2006.01) |

(52) U.S. Cl.

CPC ..... *A63B 22/02* (2013.01)

(58) Field of Classification Search

CPC ..... A63B 22/02; A63B 2022/0207; A63B 2022/0214; A63B 2022/0221; A63B 2022/0225; A63B 22/0235; A63B 22/0242; A63B 2022/025; A63B 22/0257; A63B 2022/0264; A63B 2022/0271; A63B 2022/0278; A63B 22/0285; A63B 2022/029

USPC ..... 482/51, 52, 54

See application file for complete search history.

(56) References Cited

U.S. PATENT DOCUMENTS

| | | | | |
|---|---|---|---|---|
| 4,274,625 | A * | 6/1981 | Gaetano | 482/54 |
| 5,460,586 | A * | 10/1995 | Wilkinson et al. | 482/54 |
| 5,803,874 | A * | 9/1998 | Wilkinson | 482/54 |
| 6,368,252 | B1 * | 4/2002 | Stearns | 482/52 |
| 6,409,635 | B1 * | 6/2002 | Maresh et al. | 482/57 |
| 6,821,233 | B1 * | 11/2004 | Colombo et al. | 482/54 |
| 7,153,240 | B1 * | 12/2006 | Wu et al. | 482/54 |
| 8,308,618 | B2 * | 11/2012 | Bayerlein et al. | 482/54 |
| 8,920,347 | B2 * | 12/2014 | Bayerlein et al. | 601/35 |
| 2010/0285929 | A1 * | 11/2010 | Bayerlein et al. | 482/54 |
| 2014/0087922 | A1 * | 3/2014 | Bayerlein et al. | 482/54 |

OTHER PUBLICATIONS

Woodway Treadmill. Vance Emons. Bari-Mill Model. 2010.*

* cited by examiner

*Primary Examiner* — Loan H Thanh
*Assistant Examiner* — Garrett Atkinson
(74) *Attorney, Agent, or Firm* — WPAT, PC; Justin King

(57) ABSTRACT

According to an embodiment of this invention, a treadmill is disclosed with a conveyor belt, two assistance devices, and at least a first control member. The two assistance devices are respectively arranged at a side of the conveyor belt with each assistance device comprising a handrail and two supporting bars, and each supporting bar couples to the handrail via a connecting assembly. The first control member is used to lock or release the connecting assembly, so as to adjust the distance between the two handles of the two assistance devices.

5 Claims, 4 Drawing Sheets

TRAINING MACHINE PROVIDING ADJUSTABLE HANDRAIL SPACE

CROSS-REFERENCE TO RELATED APPLICATIONS

The entire contents of Taiwan Patent Application No. 103200626, filed on Jan. 10, 2013, from which this application claims priority, are incorporated herein by reference.

BACKGROUND OF THE INVENTION

1. Field of the Invention

The present invention relates to training machines such as walk-training devices or treadmills.

2. Description of Related Art

Nowadays, people tend to lack adequate exercise due to busy lifestyles. To the extent running has become popular as a simple and effective means for squeezing physical activity into a tight schedule, it is not always practicable. When the weather is bad or during particular times (such as at night), running on a treadmill can be more convenient as compared to being outside.

Typically treadmills provide a moving platform with a wide conveyor belt allowing a user for walking or running in the same place.

Some types of treadmills or walk-training machines have two handrails arranged at two sides of the conveyor belt. The user holds the handrails to prevent being fallen down.

For conventional treadmills or walk-training machines, the distance between the two handrails is fixed and cannot be adjusted. The fixed handrail space cannot fit all users; therefore, there is a need to improve it.

SUMMARY OF THE INVENTION

In one general aspect, the present invention relates to training machines such as walk-training device or treadmills providing adjustable handrail space.

According to an embodiment of this invention, a training machine is provided with a conveyor belt on which a user walks or runs in place, and two assistance devices respectively arranged at a side of the conveyor belt. Each assistance device comprises a handrail, two supporting bars, and at least a first control member. Each handrail is at a side of the conveyor belt and parallel to the conveyor belt. Each of the two supporting bars couples with the handrail through a connecting assembly. The first control member is used to lock or release the connecting assembly, when the connecting assembly is released, the connecting assembly can be rotated to be parallel or orthogonal to the handrail.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
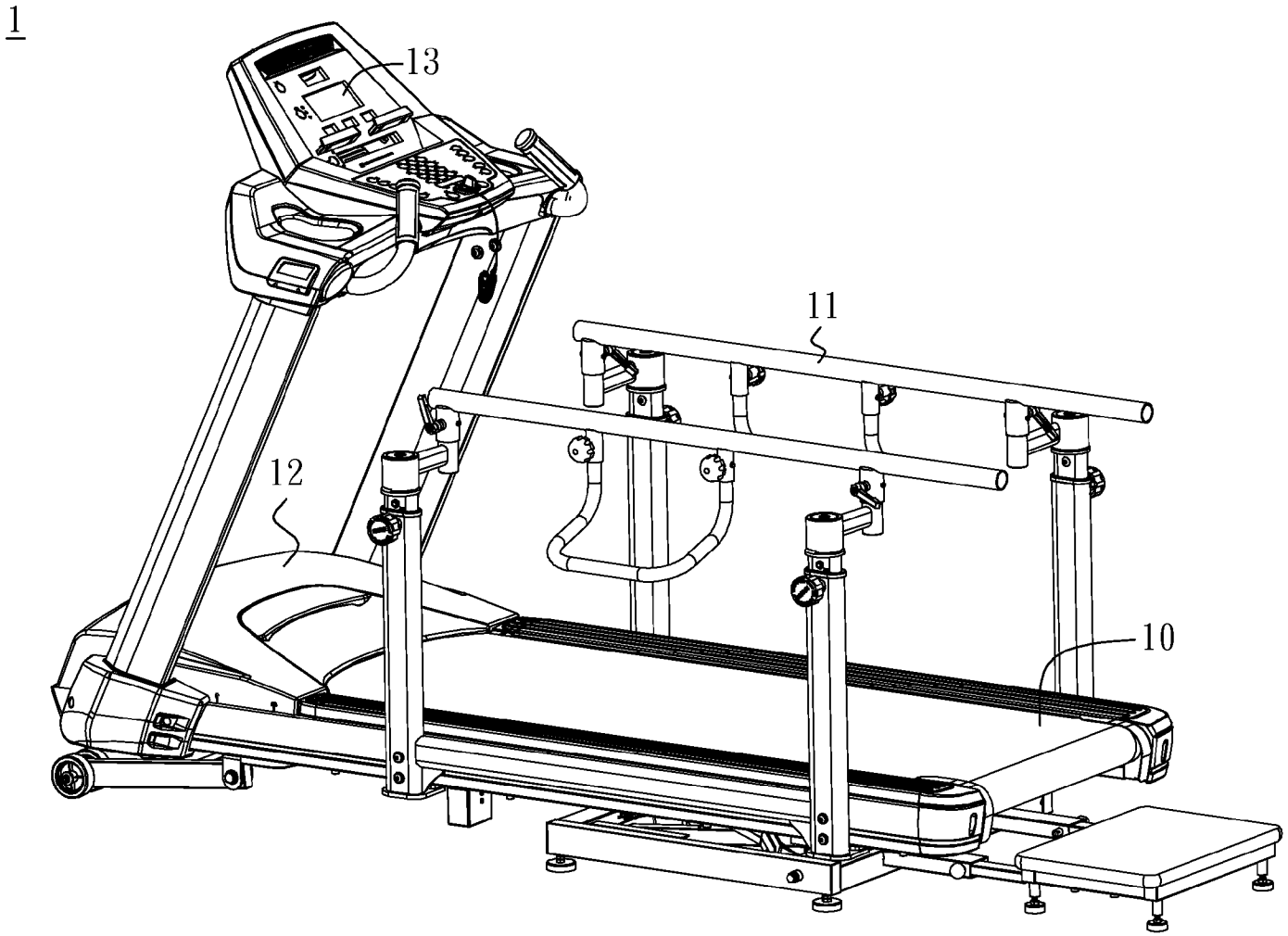
FIG. 1 is a perspective view showing a training machine according to a preferred embodiment of the present invention.

Referring to FIG. 1, a training machine 1, such as a walk-training device 1 or a treadmill 1, is disclosed according to a preferred embodiment of this invention.

The training machine 1 comprises a conveyor belt 10 and two assistance devices 11. The conveyor belt 11 is used for a user walking or running on it in place. In addition, the training machine 1 may further comprise a driving assembly 12 and an operational panel 13. The driving assembly 13 drives the conveyor belt 10 to run, and the user controls the training machine 1 through the operational panel 13.

Figure 2A:
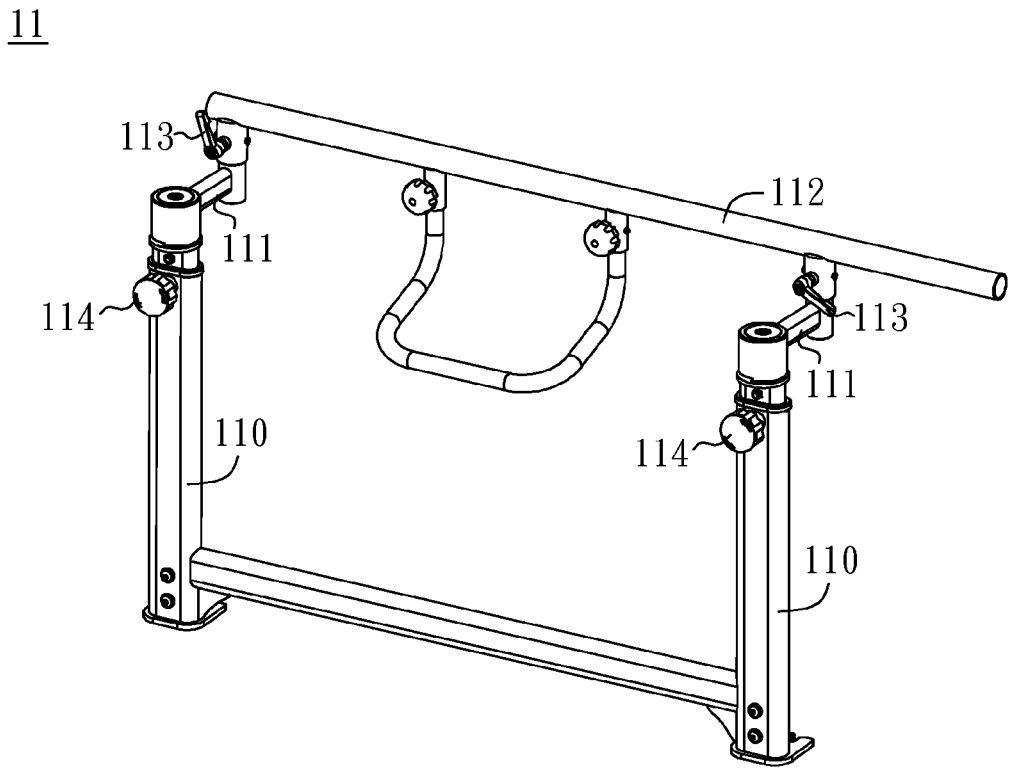
FIGS. 2A and 2B show the detail of the assistance device of the training machine according to the preferred embodiment of the present invention.
Figure 2B:
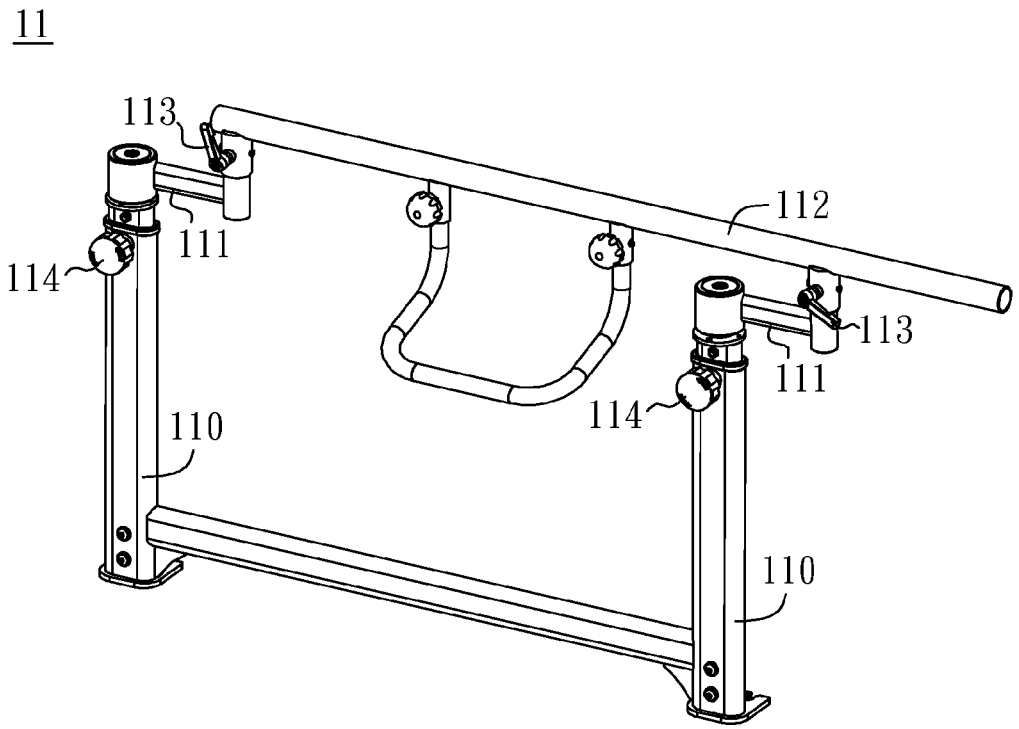

FIGS. 2A and 2B are perspective views showing the detail of one of the two assistance devices 11 of the training machine 1 according to the preferred embodiment of the present invention. Each assistance device 11 may comprise two supporting bars 110, two connecting assemblies 111, at least one or two first control members 113, and two second control members 114. The connecting assembly 111 couples the handrail 112 and the supporting bar 110. The first control member 113 is used to lock or release the connecting assembly 111. When the first control member 113 releases the connecting assembly 111, the connecting assembly 111 can be rotated, for example, by $\pi/2$ rad)(90°), so as to change the distance between the two handrails 112 at two sides of the conveyor belt, namely the handrail space. As shown in FIG. 2A, when the connecting assemblies 111 of both sides are rotated to be orthogonal to the handrail 112, the distance between the two handrails 112 is minimum. As shown in FIG. 2B, when the connecting assemblies 111 of both sides are rotated to be parallel to the handrail 112, the distance between the two handrails 112 is maximum. In addition, the second control member 114 is used to control the height of the handrail 112.

Figure 3:
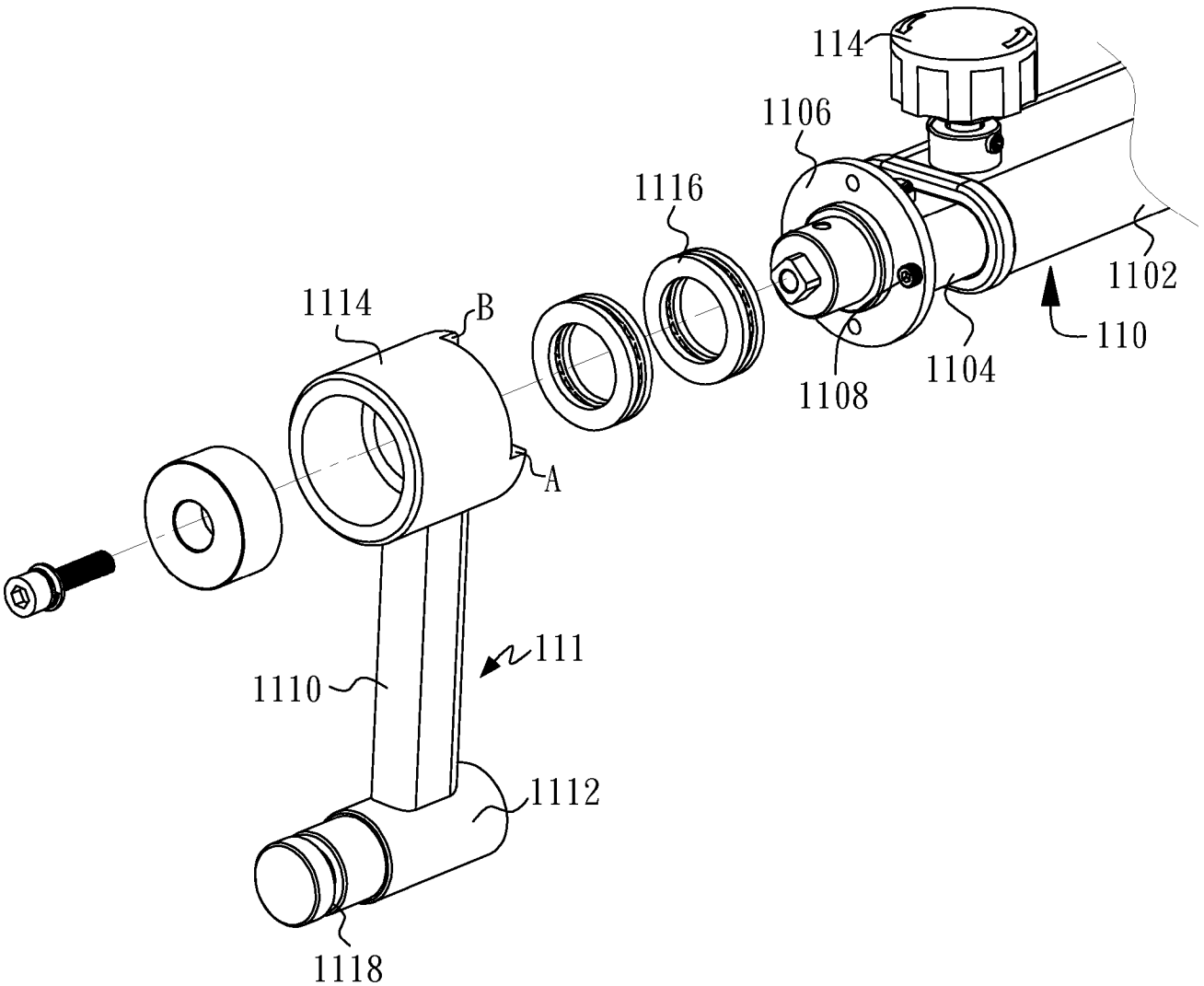
FIG. 3 is an exploded view showing a connecting assembly of the assistance device of the training machine according to the preferred embodiment of the present invention.
Figure 4:
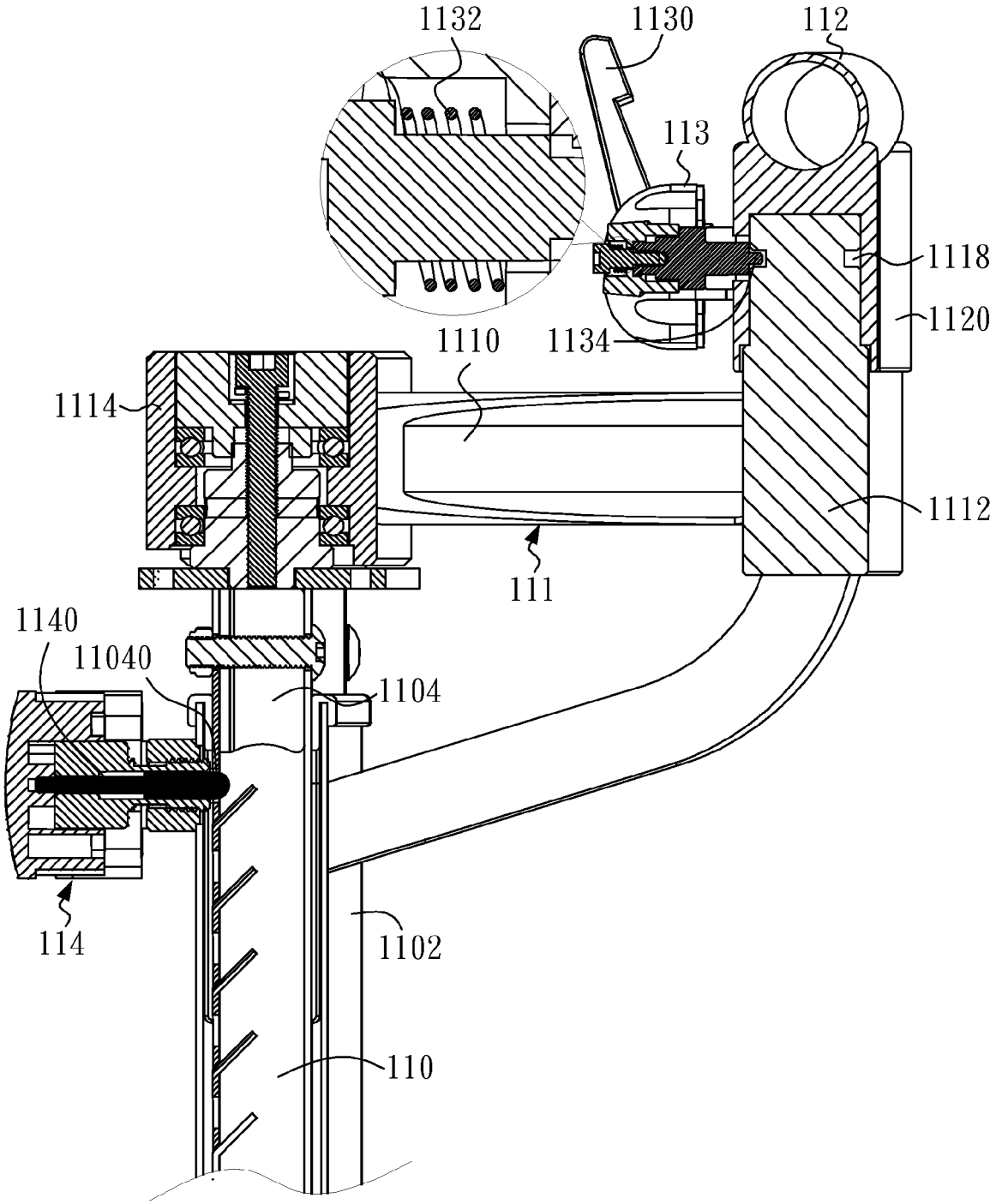
FIG. 4 is a cross-sectional view showing the assistance device of the training machine according to the preferred embodiment of the present invention.

FIG. 3 is an exploded view showing the connecting assembly 111 of the assistance device 11 of the training machine 1 according to the preferred embodiment of the present invention. FIG. 4 is a cross-sectional view showing the assistance device 11 of the training machine according to the preferred embodiment of the present invention.

Referring to FIGS. 3 and 4, the connecting assembly 111 may comprise a linkage bar 1110 with a first connecting portion 1112 at an end and a second connecting portion 1114 at another end. The first connecting portion 1112 and the second connecting portion 1114 may be cylinder-shaped or cylinder-like-shaped. The handrail 112 may comprise a cap 1120, and the first connecting portion 1112 couples to the cap 1120 of the handrail 112.

In addition, the first connecting portion 1112 may comprise a circled recess 1118. The first control member 113 may comprise a handle 1130, an elastic member 1132 (such as a spring 1132), and a plug member 1134. The elastic member 1132 exerts a force to the plug member 1134 passing through the cap 1120 and inserting into the circled recess 1118. The user can manipulate the handle 1130 to cancel the elastic force given by the elastic member 1132, and pull the plug member 1134 leaving the circled recess 1118. When the plug member 1134 is inserted into the circled recess 1118, the connecting assembly 11 is locked. When the plug member 1134 is pulled away from the circled recess 1118, the connecting assembly 111 is released and can be rotated.

Moreover, the supporting bar 110 may comprise an outer tube 1102 and an inner tube 1104. The inner tube 1104 is arranged within the outer tube 1102 and can be slid within the outer tube 1102. The second control member 1114 comprises a plug 1140. The inner tube comprises a positioning hole 11040. When the plug 1140 passes through the outer tube 1102 and is inserted into the positioning hole 11040, the inner tube 1104 is fixed and cannot be slid. When the plug 1140 leaves the positioning hole 11040, the inner tube 1104 can be slid within the outer tube 1102.

Furthermore, one end of the inner tube 1104 may comprise a pedestal 1106, and the pedestal 1106 couples to the second connecting portion 1114 via at least a thrust bearing 1116. The second connecting portion 1114 may be hollowed and a portion of its wall has been cut to form a first poisoning point A and a second positioning point B facing the pedestal 1106. The pedestal 1106 comprises a protrusion 1106. When the user manipulates the first control member 113 so as to release the connecting assembly 111, the connecting assembly 111 can be rotated. The first poisoning point A and the second positioning point B can stop the protrusion 1106, and determine the orientation of handrail 112 to be parallel or orthogonal to the connecting assembly 111. In this preferred embodiment, the radian between the first poisoning point A and the second positioning point B is $\pi/2$ rad (90°).

Accordingly, embodiments of the present invention provide training machine with adjustable handrail space that can fit different users. In addition, the thrust bearing bears the axial force so that the lifetime and reliability is increased and the rotation of the handrail is stable and smooth.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A training machine, comprising:

a conveyor belt on which a user walks or runs in place;

two assistance devices respectively arranged at a side of the conveyor belt, each assistance device comprising:

a handrail at a side of the conveyor belt and parallel to the conveyor belt;

two supporting bars coupled with the handrail through a connecting assembly; and at least a first control member to lock or release the connecting assembly, and when the connecting assembly is released, the connecting assembly can be rotated to be approximately parallel or orthogonal to the handrail;

wherein the connecting assembly comprises a linkage bar with a first connecting portion at a first end and a second connecting portion at a second end, the handrail comprises a cap, the first connecting portion couples to the cap of the handrail, and the second connecting portion couples to the supporting bar; and wherein the first connecting portion comprises a circled recess, the first control member comprises a handle, an elastic member, and a plug member, and the elastic member exerts a force to the plug member so that the plug member passes through the cap and inserts into the circled recess.

2. The training machine as set forth in claim 1, wherein the user can manipulate the handle to cancel an elastic force given by the elastic member, and pull the plug member leaving the circled recess, and when the plug member is inserted into the circled recess, the connecting assembly is locked, and when the plug member is pulled away from the circled recess, the connecting assembly is released and can be rotated.

3. The training machine as set forth in claim 1, wherein the supporting bar comprises an outer tube, an inner tube, and a second control member, the inner tube is arranged within the outer tube and can be slid within the outer tube, the second control member comprises a plug, the inner tube comprises a positioning hole, and when the plug passes through the outer tube and is inserted into the positioning hole, the inner tube is fixed and cannot be slid, and when the plug leaves the positioning hole, the inner tube can be slid within the outer tube.

4. The training machine as set forth in claim 3, wherein one end of the inner tube comprises a pedestal, and the pedestal couples to the second connecting portion via at least a thrust bearing.

5. The training machine as set forth in claim 4, wherein the second connecting portion is hollowed and a portion of a wall of the second connecting portion is cut to form a first positioning point and a second positioning point facing the pedestal, the pedestal comprises a protrusion, and when the user manipulates the first control member so as to release the connecting assembly, the connecting assembly can be rotated, and the first poisoning point and the second positioning point can stop the protrusion and determine the orientation of handrail to be approximately parallel or orthogonal to the connecting assembly.

* * * * *